United States Patent [19]

McAllister

[11] Patent Number: 4,862,527

[45] Date of Patent: Sep. 5, 1989

[54] ONE-PIECE MOLDED PLASTIC SHOWER AND ROOM DIVIDER

[75] Inventor: George P. McAllister, Franklin, Tenn.

[73] Assignee: JPI Plumbing Products, Inc., Ann Arbor, Mich.

[21] Appl. No.: 209,002

[22] Filed: Jun. 20, 1988

[51] Int. Cl.[4] ..... A47K 4/00

[52] U.S. Cl. ..... 4/612; 4/614; 52/34

[58] Field of Search ..... 4/538, 546, 555, 584, 4/596, 612, 613, 614, 663, DIG. 15; 52/34, 35, 79.4, 79.5; 264/46.8, 46.6, 46.4, 46.5

[56] References Cited

U.S. PATENT DOCUMENTS

| | | | |
|---|---|---|---|
| 2,486,371 | 11/1949 | Mankki | 4/663 |
| 2,712,863 | 7/1955 | Busch | 4/663 |
| 3,162,863 | 12/1964 | Wokas | 52/34 |
| 3,905,048 | 9/1975 | Moller | 52/34 |
| 4,215,444 | 8/1980 | Brown | 4/612 |
| 4,238,858 | 12/1980 | Maihart | 4/546 |

FOREIGN PATENT DOCUMENTS

| | | | |
|---|---|---|---|
| 0223250 | 5/1987 | European Pat. Off. | 4/584 |
| 1377766 | 9/1964 | France | 52/34 |

*Primary Examiner*—Henry J. Recla
*Assistant Examiner*—Glenn T. Barrett
*Attorney, Agent, or Firm*—Harness, Dickey & Pierce

[57] ABSTRACT

A one piece molded plastic shower stall and room divider including a one piece plastic body member shaped to form the shower stall having a U-shaped side wall, an opposite flat side wall, a rear wall and a front wall having an opening therein, and a bottom and top wall. Wall forming material is foamed or otherwise secured to the front, rear and U-shaped side wall. When the enclosure so formed is installed in an enclosed living area, the exterior of the body divides the living area into two separate rooms. The exterior of the enclosure is finished to match the decor of the living area thus properly blending as a room divider.

3 Claims, 2 Drawing Sheets

ONE-PIECE MOLDED PLASTIC SHOWER AND ROOM DIVIDER

BACKGROUND AND SUMMARY OF THE INVENTION

This invention relates generally to shower stalls and more particularly to a shower stall adapted for combination use as a room divider.

Conventional shower stalls require the construction of a frame in which the shower stall enclosure is fitted. This requires a substantial expenditure of materials and labor to construct the frame within a living space, position the shower stall enclosure in place within the frame, connect plumbing fixtures appropriately and apply finish materials over the frame to provide the finished exterior surface of the shower stall enclosure.

Especially in hotel and motel accommodations, conventional shower construction can add considerable cost to the overall construction of the room on a per room basis. Accordingly, it is an object of the present invention to provide a unitized one piece plastic shower stall and room divider which obviates the necessity for constructing a frame within the room.

It is another object of the present invention to provide a one piece shower stall enclosure stabalized and rigidified by an adhered to plastic material which provides the finished room wall surface.

A one piece molded shower stall enclosure according to the present invention has a one piece plastic body that is shaped to form the shower stall having a horizontal bottom wall, a vertical front wall having an upright entrance opening for access to the interior of the showar stall, a rear wall and a pair of vertical side walls, one of the side walls being U-shaped and extending between the front and rear walls. In addition, wall forming material is secured to the front, rear, and U-shaped side wall to form a finished wall surface enabling the shower stall and room divider to be installed in enclosed living area to serve the dual purpose of a shower stall enclosure and dividing the enclosure living area into two separate rooms, one of which communicates with the entrance opening.

The wall forming material secured to the front, rear, and side walls can also be configured to provide a partition projecting from the front wall adjacent the opening to cooperate with an opposite wall structure to form a room communicating with the shower entrance.

These and other objects, features and advantages of the invention will become evident from a consideration of the following detailed description when taken in conjunction with the accompanying drawing and the appended claims.

DETAILED DESCRIPTION OF THE INVENTION

Figure 1:
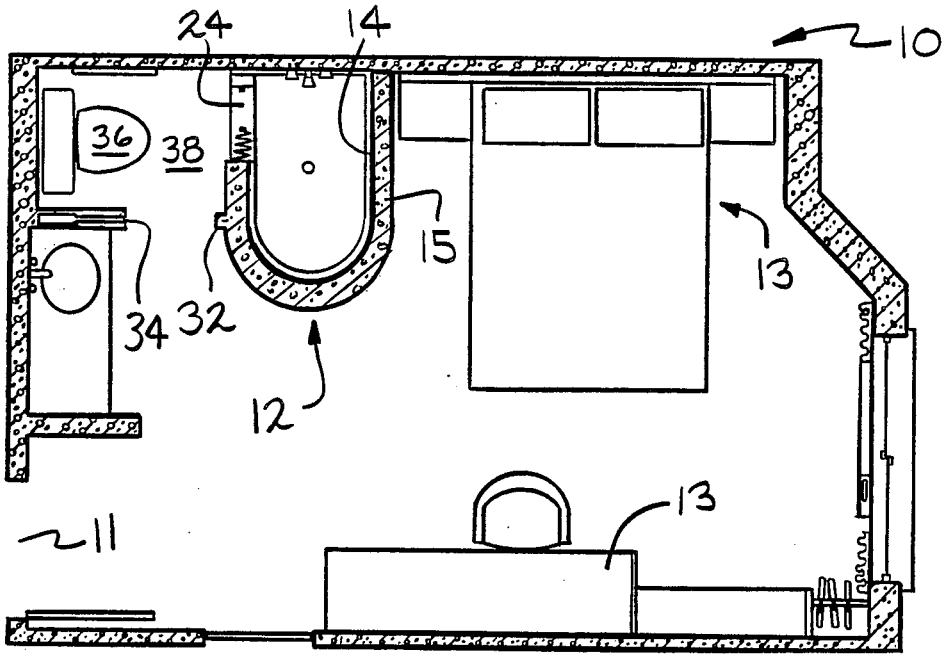
FIG. 1 is a plan view of a motel unit having the shower stall and room divider according to the present invention installed therein.

Turning now to the drawing, a motel unit 10 is shown in FIG. 1 having a one piece molded plastic shower and room divider 12 according to the present invention installed therein. The unit 10 includes an entrance door 11 and the usual motel furniture components 13. Shower and room divider 12 comprises a one piece plastic body member 14 having wall material 15 attached to the exterior surface of body 14 as shown in FIG. 1.

Figure 2:
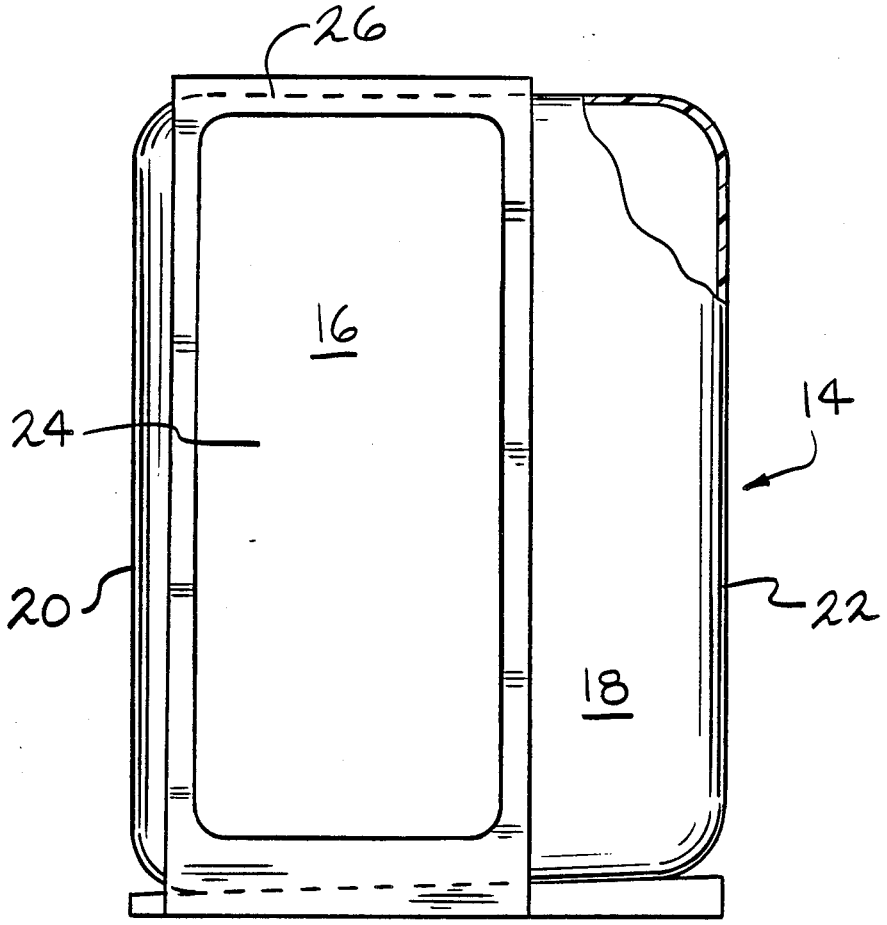
FIG. 2 is a side view of the one piece molded plastic shower and room divider according to the present invention prior to the installation of wall material.
Figure 3:
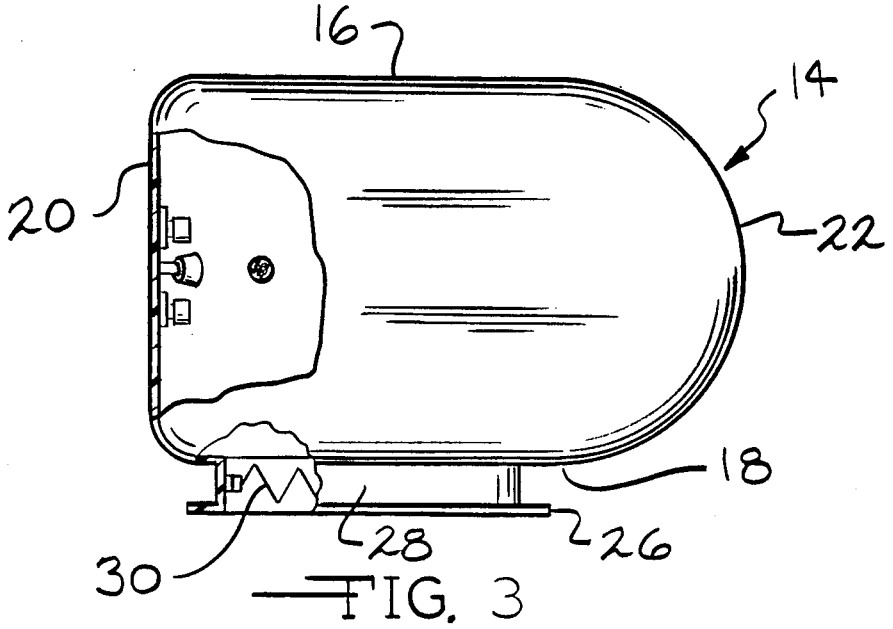
FIG. 3 is a top view of the shower stall and room divider according to the present invention shown in FIG. 2 with portions taken away to show internal components.

Molded plastic body 14 is more clearly shown in FIGS. 2 and 3. Body member 14 is a hollow, generally box shaped enclosure having a rear wall 16, a front wall 18, generally flat side wall 20 and U-shaped side wall 22. Front wall 18 includes opening 24, a flange portion 26 and a passage wall portion 28 extending outward from front wall 18 to provide a space for mounting folding curtain 30.

One piece plastic body 14 is formed by vacuum molding a sheet of plastic material whereby the heated plastic is placed over a cavity mold. A vacuum is then applied to the mold to draw the plastic into the mold to achieve the desired shape. A wall forming material 15 is then foamed onto the exterior of the rear wall 16, U-shaped side wall 22 and the front wall 18 to form a thick yet lightweight coating on plastic body 14. The outside of the formed wall forming material 15 is finished to correspond to the decor of the motel room interior walls. The assembled shower and room divider 12 can then be installed in a motel room unit in a single operation. The plubming fixtures are then connected to complete the installation. No wall finishing is required nor is it necessary to construct a frame assembly to receive the shower enclosure. This simplifies and speeds construction time considerably. Shower stall and room divider 12 may also be provided with a partition abutment 32 as shown in FIG. 1 which projects from the front wall at a position opposite wall 34. A pocket door in wall 34, for example, may then close off the toilet 36 forming a room 38 communicating with the shower entrance opening 24.

As the shower stall and room divider 12 according to the present invention may be constructed remotely from the building site, more efficient construction methods may be employed than would be present at a conventional building site. Consequently, construction and assembly time and costs are further reduced.

The result is an improved one piece molded shower stall adapted to also serve as a room divider that is both cost effective to produce and simple to install without the necessity of constructing a separate enclosure frame in the room. The invention has been described above in an illustrative manner and it is to be understood that the terminology which has been used is intended to be in the nature of words of description rather than of limitation. Many modifications and variations of the present invention are possible in light of the above teachings. It is therefore to be understood that within the scope of the appended claims, the invention may be practiced otherwise than as specifically described.

What is claimed is:

1. A one-piece molded plastic shower stall and room divider adapted to be installed within a room comprising a one-piece plastic body member shaped to form a shower stall having a bottom wall, a front wall having an upright entrance opening for ingress to and egress from the interior of said shower stall, a rear wall and a pair of side walls, one of said side walls being of generally U-shape in cross-section and extending between said front and rear walls, and wall forming material means secured to said front, rear and one side wall providing an outer finished wall appearance, said other side wall including means for securing said other side wall against a surrounding wall of said room thereby enabling said body to be installed in an enclosed living area so that said body divides the area into two separate rooms one of which communicates with said entrance opening and the other of which has one of its walls formed by said finished wall of said body.

2. The structure according to claim 1 further including upright partition means projecting from said front wall at a position to one side of said opening to cooperate with another wall structure to form a room communicating with said shower entrance opening.

3. The structure according to claim 1 wherein said one room of said two separate rooms is a bathroom and said other room is a bedroom.

* * * * *